United States Patent [19]

Hogue

[11] 4,258,483

[45] Mar. 31, 1981

[54] PROTECTIVE DEVICE FOR SPIKED ATHLETIC SHOES

[76] Inventor: Amos F. Hogue, 3339 Epworth Ave., Cincinnati, Ohio 45211

[21] Appl. No.: 23,732

[22] Filed: Mar. 26, 1979

[51] Int. Cl.[3] ..... A43B 5/00

[52] U.S. Cl. ..... 36/135; 36/7.3; 36/7.5

[58] Field of Search ..... 36/135, 72, 7.3, 7.5

[56] References Cited

U.S. PATENT DOCUMENTS

| | | | |
|---|---|---|---|
| 754,673 | 3/1904 | Mitchell | 36/135 X |
| 1,340,356 | 5/1920 | Yarnell et al. | |
| 1,379,646 | 5/1921 | Mueller et al. | |
| 1,958,107 | 5/1934 | Merrill et al. | |
| 2,032,052 | 2/1936 | Friedenberg . | |
| 2,076,316 | 4/1937 | Beals, Jr. | |
| 2,801,478 | 8/1957 | Gilbert . | |
| 2,958,963 | 11/1960 | Lougheed . | |
| 3,020,654 | 2/1962 | McCann . | |
| 3,243,902 | 4/1966 | Chapman | 36/72 |
| 3,313,047 | 4/1967 | Svien . | |
| 3,559,310 | 2/1971 | Kiela . | |
| 3,566,488 | 3/1971 | Pilarski | 36/7.5 |
| 3,763,578 | 10/1973 | Chadwell . | |
| 3,821,858 | 7/1974 | Haselden . | |
| 3,827,166 | 8/1974 | Goodman . | |
| 3,858,336 | 1/1975 | Brown . | |
| 3,883,963 | 5/1975 | Barbito, Sr. | |
| 3,913,243 | 10/1975 | Arnold et al. | |

FOREIGN PATENT DOCUMENTS

| | | | |
|---|---|---|---|
| 117557 | 11/1926 | Switzerland | 36/7.5 |

*Primary Examiner*—James Kee Chi

[57] ABSTRACT

A protective device for spiked athletic shoes to prevent damage from and by the spikes. The protective device comprises a sole portion containing a plurality of spike-accepting apertures, and resilient clips for holding the device to the athletic shoe. One of the resilient clips is designed to grip the toe welt, while a pair of spaced clips grip the heel of the shoe. In another embodiment, the heel gripping clips are staggered on opposite protective devices so that the devices may be placed together in face-to-face relationship for compact storage. In another embodiment, the clips are pivotally attached to the protective device, and can be pivoted flush with the device when not in use for storage.

13 Claims, 5 Drawing Figures

PROTECTIVE DEVICE FOR SPIKED ATHLETIC SHOES

BRIEF SUMMARY OF THE INVENTION

Many types of athletic shoes have specially designed spikes or cleats projecting from the sole and heel portions of the shoe in order to provide the athlete with better traction and firm footing. In particular, the heel and sole portion of shoes worn by golfers generally include a number of spaced downwardly projecting pointed spikes which provide the proper traction while insuring minimal disturbance of green and fairway turf.

In many instances, such golf shoes cannot be worn while walking across hard pavement surfaces without damaging the spikes or greatly increasing the chance of slipping or falling. Furthermore, the shoes cannot be worn while walking across finished surfaces such as wood or carpeted floors without the danger of damage to the floor. Consequently, it has been common practice for golfers to change from golf shoes to street shoes following a round of golf before further recreational activities can be enjoyed. This practice is not only time consuming and troublesome, but requires that the golfer have an extra pair of shoes ready at hand.

Various approaches have been suggested by prior art workers for protective devices to be slipped over or secured to the athletic shoe in order to provide a protective cushion between the cleats or spikes and the walking surface. While these devices have provided satisfactory service as a general rule, they have not been universally acceptable for several reasons. First, many of the devices are difficult to attach to the golf shoe, in some instances requiring special fitting tools, thereby making it just as convenient for the golfer to change to another pair of street shoes, rather than to use the protective device. Other types of protective devices may not stay in place as the sole portion of the shoe is flexed. Other types of protective devices serve only to cover the heel or sole portions of the shoe, and thus do not provide adequate protection for athletic shoes having spikes or cleats located on both the heel and sole. Finally, the unnecessary complexity of some types of athletic shoe protective devices has prevented their wide spread use at a cost the average weekend golfer can afford.

The protective device of the present invention overcomes the limitations of known athletic shoe protective apparatus by providing a simple compact arrangement which is easily attached to a golf shoe, for example, in order to provide protection for both the heel and sole portions, and which will not come loose under ordinary use. Furthermore, the protective device of the present invention is sufficiently compact that it can be easily carried with the golfer and attached to the shoes when needed.

Fundamentally, the protective device comprises a flexible multi-layer plate-like sole having a shape generally corresponding to the outline of the shoe welt. The uppermost surface of the upper layer of the sole abuts the heel portion and at least a part of the sole portion of the shoe. The lowermost surface of the lower layer of the sole is configured to provide a suitable non-slip walking surface. A plurality of spike-accepting apertures extend partially or completely through the sole, and are arranged in a pattern corresponding to the pattern of the spikes projecting from the bottom of the shoe. A recess or counterbore surrounds each aperture to guide the spikes into their respective apertures when the protective device is attached to the shoe.

The protective device is secured to the shoe by resilient clips extending upwardly from the sole which grip the shoe welt when the lower surface of the shoe is pressed against the upper surface of the sole. A first resilient spring clip engages the welt near the toe of a shoe, while a second resilient spring clip grips the shoe welt near the heel of the shoe. An intermediate spring clip projecting upwardly from the mid portion of the sole may be provided to grip the forward edge of the heel.

In an alternate embodiment, the heel gripping clips may be replaced by a pair of spaced resilient spring clips extending upwardly from the outer edges of the sole which grip the outside edges of the heel welt. These heel gripping springs may be offset longitudinally on the protected device associated with the right and left shoe, respectively, so that the protective devices may be clipped face-to-face to provide compact storage. Alternatively, the clips may be hinged to the sole and folded down against the outer edges of the sole when not in use.

DETAILED DESCRIPTION

Figure 1:
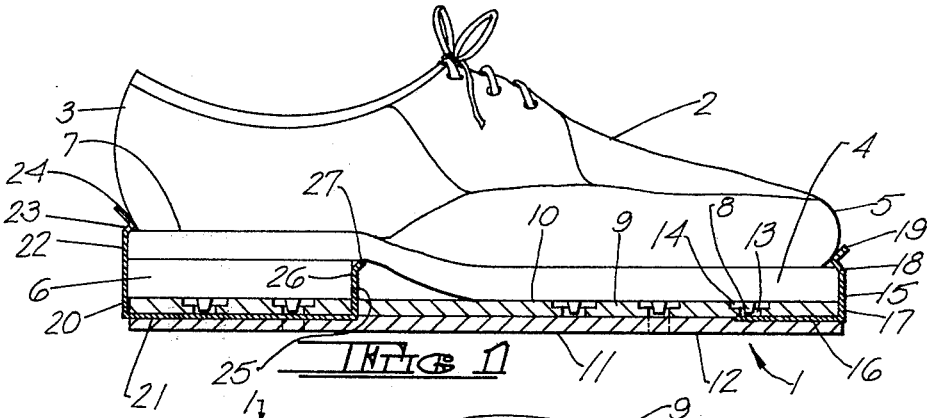
FIG. 1 is a side elevation view, partially in cross section, of the protective device of the present invention attached to a typical golf shoe.
Figure 2:
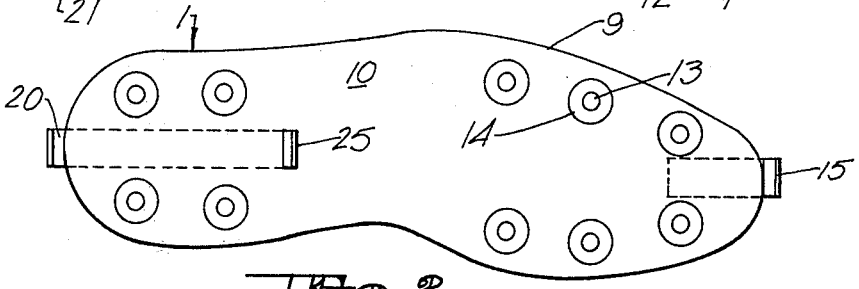
FIG. 2 is a top plan view of the protective device of the present invention.

FIG. 1 illustrates the protective device of the present invention, shown generally at 1, attached to a typical golf shoe 2. In general, shoe 2 includes an upper 3, a sole portion 4 extending from the toe 5 to approximately the midpoint of the shoe, and a heel portion 6. A ledge-like welt 7 extends arround the periphery of the lower portion of the shoe. In some types of construction, the welt 7 may be minimal or non existent at the heel portion 6 of the shoe.

A number of downwardly projecting pointed or truncated spikes, one of which is shown at 8, are secured to the forward portion of sole 4 and to heel 6. It will be understood that the size and placement of spikes 8 may vary among various types of shoes. For purposes of an exemplary showing, shoe 2 includes four such spikes 8 arranged in a square pattern on heel 6, and six spikes 8 arranged in a chevron pattern on the forward portion of sole 4.

Protective device 1 comprises an upper substantially planar layer 9 of leather, rubber, plastic, composition material or the like, having a shape generally corresponding to the outline of welt 7. The upper surface 10 of upper layer 9 may be provided with a roughened or textured surface to prevent slippage between upper surface 10 and the sole and heel portions of shoe 2. Upper layer 9 may be of such a length as to completely cover all or a portion of sole 4 and heel 6. In any event, it will be understood that upper layer 9 will be dimensioned to cover that portion of the lower surface of shoe 2 containing spikes 8.

A lower layer 11 is secured as by gluing, riveting or the like, to the lower surface of upper layer 9, and will generally be of the same shape and configuration. The lower surface 12 of lower layer 11 will be provided with a suitable finished or textured surface in order to provide a non-slip walking surface. It is preferred that upper layer 9 and lower layer 11 be constructed of a flexible material so as to bend as the sole portion 4 of shoe 2 bends during normal walking.

Upper surface 9 is provided with a plurality of apertures, one of which is shown at 13, which are dimensioned and positioned to accept one of spikes 8. Apertures 13 may extend partially or completely through upper layer 9, and may also pass partially or completely through lower layer 11 as desired. Apertures extending completely through protective device 1 prevent accumulation of dirt within the apertures. It will be understood that in any event, the thickness of upper layer 9 and the depth of aperture 13 will be such that the lower end of spikes 8 avoid contact with lower layer 12. A recess or counterbore 14 may also be provided surrounding apertures 13 in order to assist in guiding spikes 8 into apertures 13 when protective device 1 is attached to shoe 2, as will be explained in more detail hereinafter.

The forward end of protective device 1 is secured to the toe portion 5 of shoe 2 by means of a resilient spring clip 15. Clip 15 comprises a rearwardly extending horizontal tab portion 16 which is sandwiched between upper and lower layers 9 and 11. The forward edge of tab 16 terminates in an upstanding web 17, the upper end of which terminates in a rearwardly extending flange portion 18. Web 17 will be of such a height so that the lowermost surface of flange 18 abuts the upper edge of the toe portion of welt 7. The rearward edge of flange 18 extends angularly upwardly and forwardly as at 19. In general, spring clip 15 will be constructed of a resilient metallic or plastic material such that upstanding web 17 may be bent slightly forwardly to clear the forward edge of the toe portion of welt 7, and when released will urge the toe portion of welt 7 rearwardly and downwardly to firmly hold the toe portion of protective device 1 against the toe portion of shoe 2.

The heel portion of protective device 1 is secured to the heel of shoe 2 in a similar manner by means of resilient spring clip 20. Spring clip 20 comprises a forwardly extending web portion 21 sandwiched between the heel portions of upper layer 9 and lower layer 11. The rear edge of web 21 terminates in an upstanding web portion 22, the forwardmost edge of which abuts the rearmost edges of heel 6 and welt 7. The upper end of web portion 22 terminates in a forwardly extending flange 23 similar to flange 18, which is designed to grip the upper edge of welt 7. Finally, the forwardmost end of flange 23 is turned angularly rearwardly and upwardly as at 24. In general, spring clip 20 will be constructed of a resilient plastic or metallic material so that web portion 22 may be bent slightly rearwardly to accept the heel portion of shoe 2, and when released will urge the heel portion forwardly and downwardly to firmly hold the heel portion of protector device 1 in place. It will be understood that in shoe constructions lacking a pronounced heel welt, flange 23 may be partially or entirely eliminated, so that welt portion 22 will grip heel 6 in order to hold protector device 1 in place.

An intermediate resilient spring clip 25 may also be provided to grip the forward edge of heel 6. As best shown in FIG. 1, spring clip 20 and spring clip 25 may be formed from a single piece of resilient material so that the forward end of web 21 terminates in an upstanding tongue 26 which passes through upper layer 9. Tongue 27 is biased so as to firmly engage the forward edge of heel 6 as it is urged rearwardly. The uppermost edge of tongue 26 may be angularly turned forwardly as at 27.

In operation, protective device 1 is placed on the ground with resilient clip 15 extending upwardly and aligned with the toe portion 5 of shoe 2. The forward part of sole portion 4 is placed on the forward portion of upper layer 9 with the forwardmost edge of welt 7 extending beneath flange 18. It will be observed that the upturned portion 19 of clip 15 facilitates displacement. With spikes 8 aligned approximately over apertures 13, the wearer then steps downwardly onto protective device 1 seating heel 6 between resilient clip 20 and resilient clip 25. The recessed portions 14 surround apertures 13 insure that spikes 8 are guided easily into the apertures.

To remove the protective device, a reverse procedure is followed. Upturned portion 19 of clip 15 of upturned portion 23 of clip 20 is grasped with the fingers and pulled outwardly away from the shoe, thus permitting the entire protective device 1 to be disengaged from the shoe. It will be observed that the substantially flat configuration of protected device 1 permits it easily to be stored in a golf bag or the like.

Figure 3:
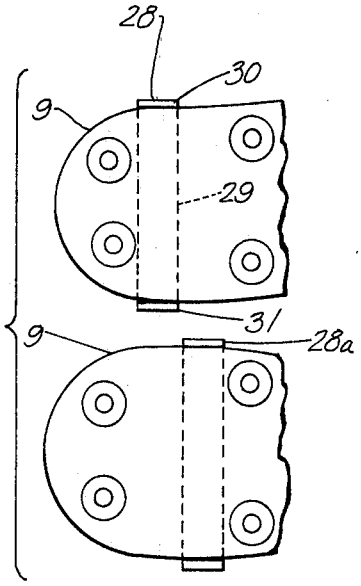
FIG. 3 is a fragmentary top plan view of an alternate embodiment of the heel gripping clips of the protective device of the present invention.
Figure 4:
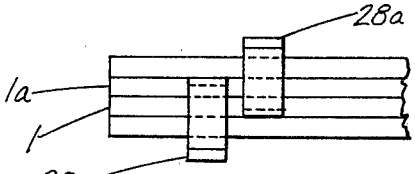
FIG. 4 illustrates the face-to-face storage configuration of the embodiment of FIG. 3.

An alternative construction for the heel gripping clips is illustrated in FIG. 3. In this arrangement, a single piece strip-like clip 28 extends transversely of the heel portion of protective device 1, and comprises a flat web portion 29 sandwiched between upper and lower layers 9 and 11, which terminates at its ends in upstanding clip members 30 and 31 similar in construction to clip 20. This arrangement permits clip members 30 and 31 to grip the side edges of the heel portion of shoe 2 at or near welt 7. The attachment and removal of protective device 1 to shoe 2 will be accomplished as described hereinabove.

As shown in FIG. 3, the heel gripping clip **28*a* used with the protective device for the opposite foot is positioned at a slightly greater distance from the rear edge of the protective device. Consequently, for storage purposes, the protective device 1*a* containing heel gripping clip 28*a* may be inverted and placed on top of protective device 1 containing heel gripping clip 28**, with the uppermost surfaces of the upper layers of the protective devices in facing engagement. The edges of the protective members will be held in place against the inner surfaces of the resilient spring clips to lock the protective devices together and provide a compact storage arrangement.

Figure 5:
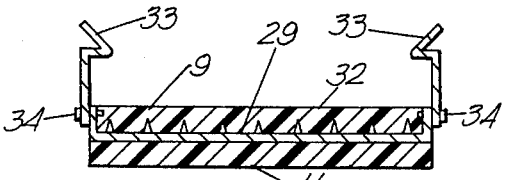
FIG. 5 is a cross sectional view of an alternative embodiment utilizing hinged resilient spring clips.

Another alternative construction for the spring clips is illustrated in FIG. 5. In general, this construction is similar to that illustrated in FIG. 3, and comprises a web member 29 extending transversely across the heel portion of the protected device between upper and lower layers 9 and 11. Web 29 may be provided with one or more tooth-like projections 32, as required, to hold the spring clip firmly in place. The outer ends of web member 29 terminate in upstanding clips 33 similar in construction to clips 28. However, the lower ends of clips 33 are pivotally attached to the outer ends of web 29 as at 34. Consequently, for storage purposes, clips 33 may be pivoted downwardly so as to lie approximately flush with the upper surface 10 of upper layer 9. It will be understood that clip 15 positioned at the toe end of protective device may be constructed in a similar manner.

It will be understood that various changes in the details, materials, steps and arrangements of parts, which have been herein described and illustrated in order to explain the nature of the invention, may be made by those skilled in the art within the principal and scope of the invention as expressed in the appended claims.

The embodiments of the invention in which an exclusive property or privilege is claimed are as follows:

1. A protective device for golf shoes and the like of the type having a plurality of downwardly projecting spikes and an outwardly extending lip-like welt edge, said device comprising a flexible one piece plate-like sole, the upper surface of said sole being configured to abut at least a part of the lower surface of said shoe, the lower surface of said sole being configured to provide reliable footing, a plurality of spike-accepting apertures in said sole, said apertures being arranged and dimensioned to accept said spikes, and means for attaching said sole to said shoe, said attaching means comprising a resilient clip extending upwardly adjacent the toe-abutting end of said sole, said clip including means for gripping said welt comprising an upstanding resilient web terminating at its upper end in a rearwardly directed flange, said web being urged rearwardly against said welt, the lower surface of said flange engaging the upper surface of said welt, said attaching means including gripping means attached to said sole for gripping the heel of the shoe.

2. The protective device according to claim 1 wherein said apertures are surrounded by a recess-like counterbore.

3. The protective device according to claim 1 wherein said clip comprises an upstanding resilient web terminating at its upper end in a rearwardly directed flange, said web being urged rearwardly against said welt, the lower surface of said flange engaging the upper surface of said welt.

4. The protective device according to claim 1 wherein the rear edge of said flange terminates in an upwardly and forwardly extending member.

5. The protective device according to claim 1 wherein said gripping means comprises spaced upstanding resilient clips arranged to abut oppositely disposed surfaces of the shoe heel.

6. The protective device according to claim 5 wherein at least one of said clips includes means for gripping said welt.

7. The protective device according to claim 5 wherein said clips are arranged to abut the side edges of said heel.

8. The protective device according to claim 5 wherein said clips are arranged to abut the front and rear edges of said heel.

9. The protective device according to claim 5 wherein said device includes a strip-like connecting member connected between the lower ends of said clips, said connecting member being attached to said sole.

10. The protective device according to claim 9 wherein said sole comprises an upper layer and a lower layer, said connecting member being sandwiched between said layers.

11. The protective device according to claim 5 including one of said devices for a left footed shoe and one of said devices for a right footed shoe, said gripping means being offset on each of said devices so that said devices may be placed together in face-to-face relationship without interference between said gripping means, said gripping means acting to hold said devices together.

12. The protective device according to claim 5 wherein said resilient clips are pivotally attached to said sole.

13. The protective device according to claim 1 wherein said apertures extend completely through said sole to prevent accumulation of dirt and debris therein.

* * * * *